United States Patent [19]

Marlin et al.

[11] Patent Number: 4,976,256

[45] Date of Patent: Dec. 11, 1990

[54] BODY MASSAGE APPARATUS

[76] Inventors: Dave B. Marlin; Earl B. Marlin, Jr., both of 2688 Lane St., I-85, Exit 63, Kannapolis, N.C. 28081

[21] Appl. No.: 369,320

[22] Filed: Jun. 20, 1989

[51] Int. Cl.[5] ..... A61H 23/00; A47C 31/00

[52] U.S. Cl. ..... 128/64; 128/33; 5/451

[58] Field of Search ..... 128/38, 39, 40, 64, 128/65, 66, 24 R, 32, 33, 24.1; 5/451, 453

[56] References Cited

U.S. PATENT DOCUMENTS

| | | | |
|---|---|---|---|
| 3,747,916 | 7/1973 | Benson | 128/70 |
| 4,112,943 | 9/1978 | Adams | 128/64 |
| 4,339,833 | 7/1982 | Mandell | 128/66 |
| 4,607,405 | 8/1986 | Ellis et al. | 128/66 |
| 4,635,620 | 1/1987 | Ricchio | 128/64 |
| 4,651,720 | 3/1987 | Baus | 128/66 |
| 4,751,919 | 6/1988 | Thomsen | 128/66 |
| 4,757,562 | 7/1988 | Mützell | 128/66 |
| 4,757,808 | 7/1988 | Effler, Jr. | 128/66 |
| 4,853,988 | 8/1989 | Mützell | 128/66 |
| 4,908,016 | 9/1990 | Thomsen | 128/66 |

FOREIGN PATENT DOCUMENTS

| | | |
|---|---|---|
| 2003137 | 7/1971 | Fed. Rep. of Germany . |
| 2161678 | 6/1983 | Fed. Rep. of Germany . |
| 161694 | 5/1923 | Switzerland . |

OTHER PUBLICATIONS

Flotation Sleep Industry, Mar. 1985, p. 61, Advertisement Hammacher Schlemmer, Fall Supplement.

*Primary Examiner*—Edgar S. Burr
*Assistant Examiner*—Lisa Malvaso
*Attorney, Agent, or Firm*—Shefte, Pinckney & Sawyer

[57] ABSTRACT

An apparatus for full length and localized massage of a user's body includes a bed structure having a housing defining an interior chamber, a liquid reservoir basin beneath the chamber, and an upwardly-facing opening horizontally across which a resiliently flexible membrane is sealingly affixed in tensioned condition to form a user body support surface. The reservoir basin contains a quantity of a massage liquid, preferably water, with the remainder of the chamber being filled with air. A massage head having multiple liquid emission openings therein is disposed within the chamber for lengthwise traversing travel with the emission openings facing the membrane. A pump communicates with the reservoir basin and with a downstream series of conduits connected to the massage head for withdrawing the massage liquid from the reservoir basin and supplying the liquid under pressure to the massage head for emission against the underside of the membrane to transmit a massaging effect to the body of a user laying thereon.

19 Claims, 3 Drawing Sheets

BODY MASSAGE APPARATUS

BACKGROUND OF THE INVENTION

The present invention relates to an apparatus for applying a massaging effect to the body of a user.

Massage is a time-honored and generally effective therapy for muscular injuries, strains and general soreness but, although massage is still recommended by many physicians for such purposes, this therapy is largely unavailable due to a scarcity of trained, qualified masseurs As a result, many devices and apparatus have been proposed in the past for producing a massage-like manipulation of a user's body by mechanically or electrically-generated vibrations or pulsations, usually accompanied by heating. In addition, massage-simulative devices utilizing pulsations of pressurized water have recently become popular, such as pulsation-type shower heads, whirlpool baths, and the like. U.S. Pat. No. 4,751,919 discloses another form of massaging apparatus wherein multiple pulsation-type shower heads are mounted for longitudinal movement back-and-forth within a water-tight enclosed lid pivoted to a horizontal bench for movement into and out of overlying relation to a user on the bench to provide the advantage of applying a massaging effect to the user's entire body without requiring the user to disrobe.

SUMMARY OF THE INVENTION

It is an object of the present invention to provide a body massage apparatus which is of substantially simplified construction and operation over the aforementioned apparatus of U.S. Pat. No. 4,751,919, while offering all of the advantages thereof.

Briefly summarized, the body massage apparatus of the present invention includes a bed structure having a housing defining an interior massage chamber and an upwardly-facing opening communicating with the massage chamber, and a resiliently flexible membrane affixed to the housing in substantially sealing relation generally horizontally across the opening and in sufficiently tensioned condition for forming a body support surface on which a user may lay for massage treatment. The chamber is at least partially filled with air and a fluid jet arrangement is disposed within the chamber for directing a fluid jet emission at the membrane. A suitable arrangement is provided for supplying a quantity of massage fluid under pressure to the fluid jet arrangement for emission thereby with sufficient force to transmit a massaging effect through the membrane to the body of a user laying thereon.

In the preferred embodiment, a liquid such as water is utilized as the massage fluid, the housing additionally defining a liquid reservoir basin beneath the massage chamber for containing a quantity of the massage liquid while the remainder of the massage chamber is substantially filled with air. A net is affixed to the housing in tensioned condition generally horizontally across the opening beneath the membrane for auxiliary support of a user, the net being of an open mesh construction for generally unrestricted passage therethrough of the massage liquid. The fluid supply arrangement is adapted to withdraw the massage liquid from the reservoir basin for pressurized supply to the massage head. A heater is preferably disposed within the reservoir basin for heating the massage liquid.

Preferably, the fluid jet arrangement is a massage head disposed within the massage chamber on tracks for guided traversing travel substantially along, and in facing relation to, the membrane. The massage head includes a plurality of emission openings for directing multiple fluid jet emissions at the membrane and preferably includes a pulsation device for emitting the massage liquid in rapidly succeeding pulses. The traversing movement of the massage head is driven by a drive screw extending longitudinally through the massage chamber in threaded drive engagement with the massage head and operatively connected with a reversible drive motor. Controlled reversal of the drive motor is provided by sensors located at opposite ends of the housing to define the opposite ends of the traversing travel of the massage head, the control system also including the capability for selectively determining a lesser extent of traversing travel of the massage head intermediate the sensors.

DESCRIPTION OF THE PREFERRED EMBODIMENT

Figure 1:
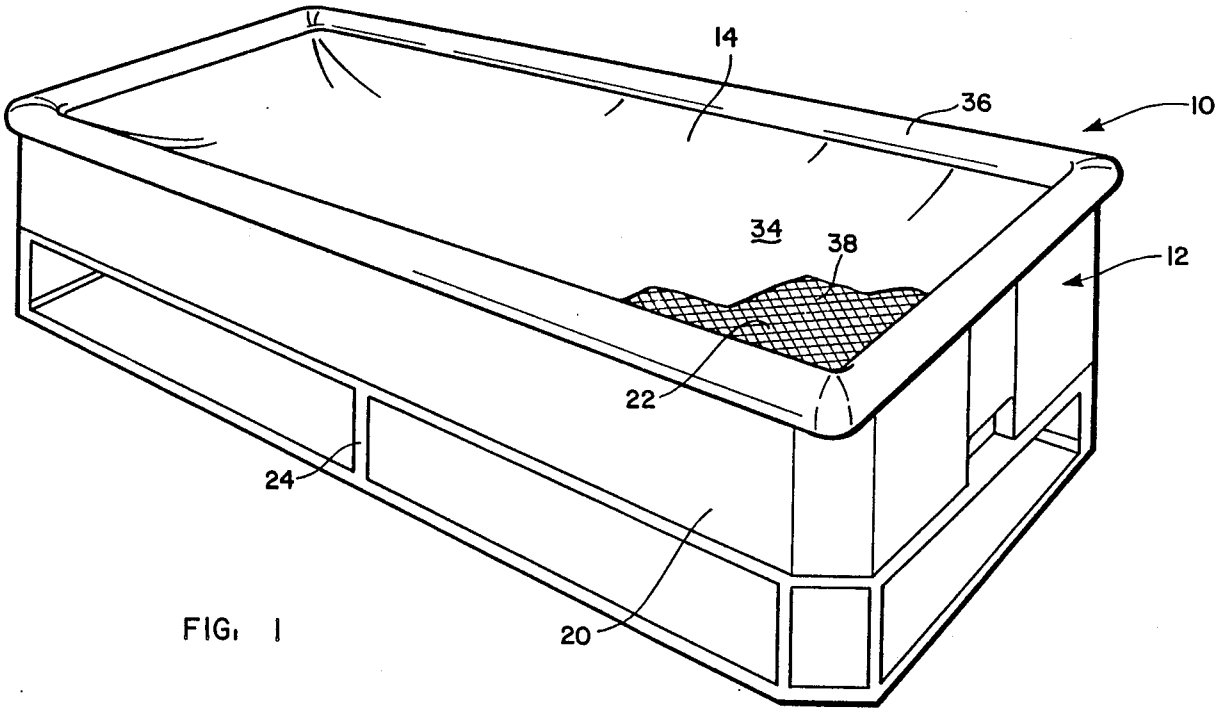
FIG. 1 is a perspective view of a body massage apparatus according to the preferred embodiment of the present invention.
Figure 2:
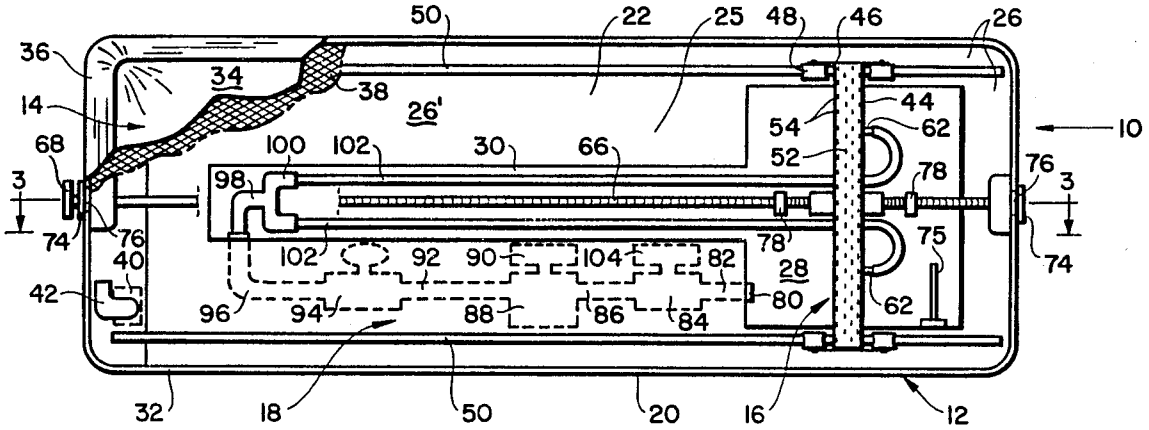
FIG. 2 is a top plan view of the body massage apparatus of FIG. 1, partially broken away to show the interior components thereof.
Figure 3:
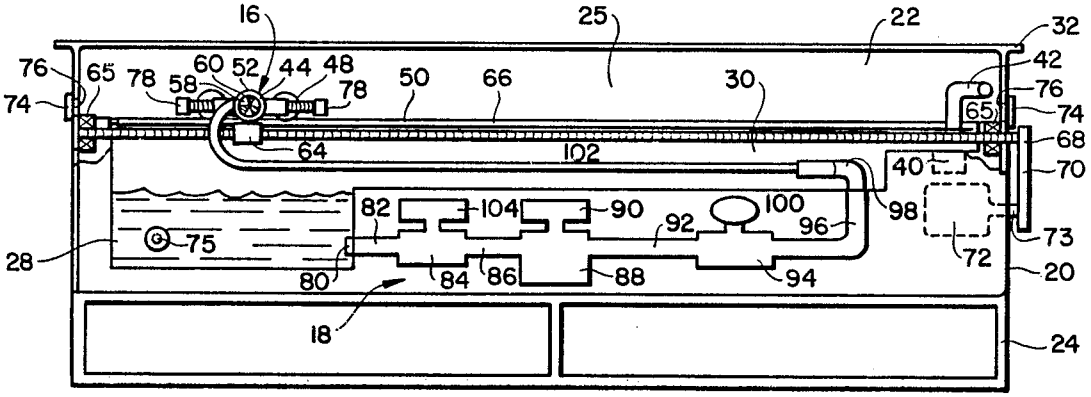
FIG. 3 is a vertical cross-sectional view of the body massage apparatus of FIG. 1, taken along the line 3—3 of FIG. 2.

Referring now to the accompanying drawings and initially to FIGS. 1–3, a body massage apparatus according to the preferred embodiment of the present invention is generally indicated at 10. The body massage apparatus 10 includes a bed structure, generally indicated at 12, the upwardly facing side 14 of which forms a body support surface on which a user may lay for massage treatment, as more fully explained hereinafter. A fluid jet arrangement, generally indicated at 16 in FIGS. 2 and 3, is housed within the bed structure 12 in association with a pressurized fluid supply arrangement, generally indicated at 18 in FIGS. 2 and 3, for directing a fluid jet emission at the underside of the bed structure support surface 14 to transmit a massaging effect therethrough to the body of a user laying thereon.

The bed structure 12 includes a substantially hollow housing 20 generally in the form of a tank or tub of an overall rectangularly parallelipiped configuration closed at its bottom and side walls and substantially open at its top to define an upwardly-facing rectangular opening 22 The housing 20 may be fabricated of any suitable watertight, rigid material of appropriate strength which may be formed to the desired configuration herein described, fiberglass or a like material being preferred. The housing 20 is mounted on a floor-standing frame 24, preferably fabricated of metal tubing or the like, to elevate the user support surface 14 at a desired spacing above the floor while also providing an open area within the frame 24 and beneath the housing 20 for enclosure of various operating components of the body massage apparatus 10.

The configuration of the hollow interior chamber 25 defined by the housing 20 may best be seen and understood with reference to FIGS. 2 and 3. The housing 20 includes a generally horizontal shelf 26 which extends inwardly of the housing 20 about its full interior perimeter approximately midway of the overall height of the housing 20. The housing 20 further includes a reservoir basin 28 extending downwardly from the shelf 26 to the full depth of the housing 20 at one longitudinal end thereof and a more shallow drainage trough 30 extending lengthwise through the remainder of the interior chamber 25 of the housing 20 between enlarged regions 26, of the shelf 26 to open into the reservoir basin 28. A flange 32 projects outwardly from the uppermost extent of the housing 20 for mounting thereto of the user support surface 14.

A liquid material is preferred as the fluid medium utilized by the body massage apparatus 10 for supply to and emission from the fluid jet arrangement 16 to produce a massage effect as hereinafter described, water being the optimal liquid in view of its ready availability and generally non-corrosive and non-caustic character. A suitable supply of water, or another appropriate liquid, is stored in the liquid reservoir basin 28 for continuous circulation through the fluid supply arrangement 18 and the fluid jet arrangement 16, the shelf 26 and the drainage trough 30 as well as the other interior surfaces of the housing 20 being configured to drain the liquid emitted from the fluid jet arrangement 16 into the basin 28. Of course, as those persons skilled in the art will readily recognize, pressurized air, other gases, and other fluidic materials may also be utilized as the fluid massaging medium without departing from the scope and substance of the present invention and, accordingly, the present invention is not intended to be and should not be construed as limited to the use of water or another liquid massage medium.

Figure 5:
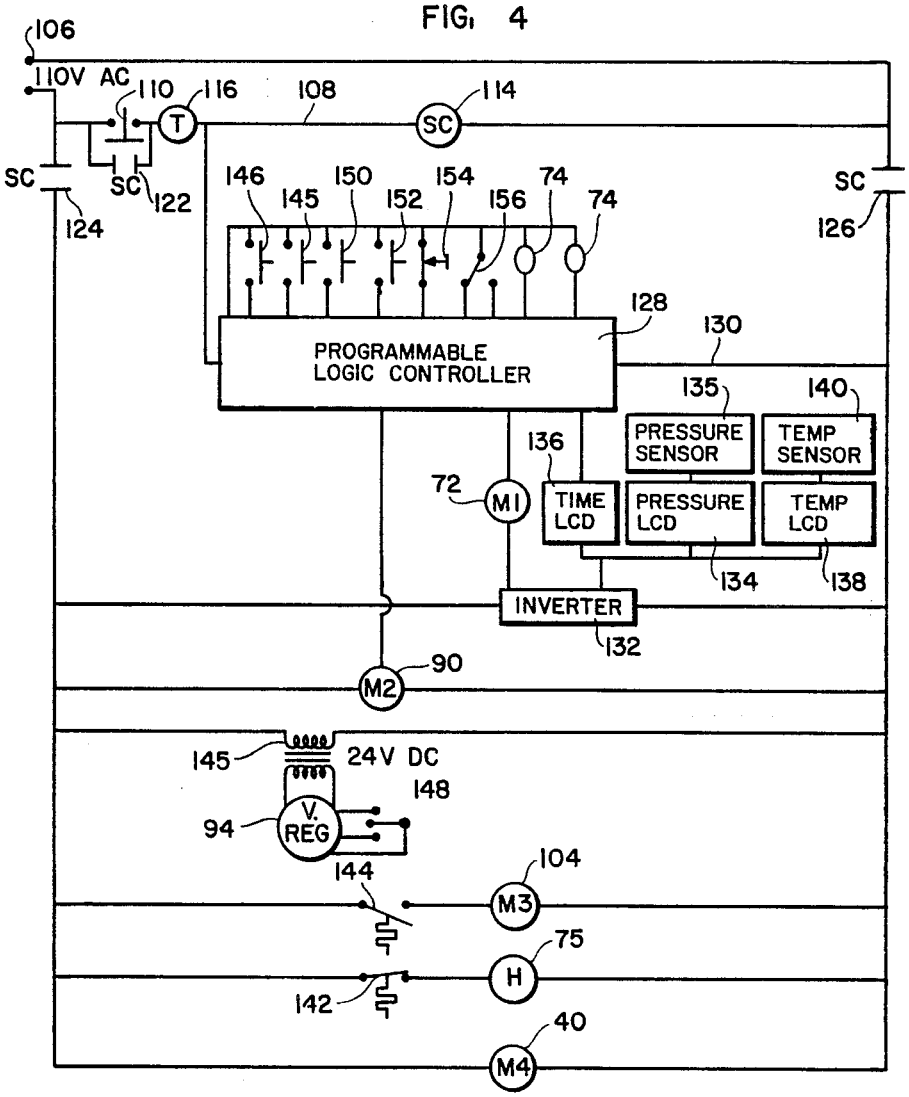
FIG. 5 is a schematic diagram of the electrical control circuitry for the body massage apparatus of FIG. 1.

It is also preferred that the water or other massage liquid be heated to a temperature approximating normal body temperature, preferably in the range of 95 to 100 degrees Fahrenheit, to enhance the massaging effect produced by the liquid, although the apparatus has the capability of a broad range of liquid temperatures. For this purpose, an electrically-operated resistance heater element 75 is mounted to a side wall of the housing 20 at a location within the liquid reservoir basin 28 below the normal level of massage liquid therein to be substantially continuously submerged in the stored massage liquid. A thermostat, shown only in FIG. 5, is provided in the electrical circuit to the heating element 75 to provide selective control of the temperature of the massage liquid.

The user support surface 14 is formed of a relatively thin sheet 34 of a waterproof material affixed in watertight relation to the underside of a cushioned rectangular frame 36 corresponding in dimension to the upper flange 32 of the housing 20 for watertight mounting thereto. The sheet 34 is held by the frame 36 in a sufficiently tensioned condition and is of sufficient strength to support the weight of a user laying thereon. At the same time, the sheet 34 should be sufficiently thin that the impact of jetted fluid from the fluid jet arrangement 16 against the underside of the sheet 34 transmits a massaging effect through the sheet 34 to the body of the user. Further, the sheet 34 is preferably of a sufficient flexibility and resiliency to substantially conform to the body of the user for maximum transmission of the massage effect through the sheet 34 to the user. In this manner, the sheet 34 functions in the nature of a waterproof membrane to keep the user dry during operation of the body massage apparatus 10 without noticeably dampening the massaging impact of jetted fluid from the fluid jet arrangement 16. A latex rubber in sheet form, preferably in the range of 20 to 40 mil. thickness, is an optimal material to provide these characteristics for the sheet 34, although various other commercially available rubber and plastic sheeting materials should also provide suitable results.

As an auxiliary means of user support, an open-mesh rope-type netting 38 is affixed in tensioned condition to the flange 32 of the housing 20 horizontally across its opening 22 immediately beneath the sheet 34. The netting 38 should be of sufficient strength to independently support the weight of a user to provide a safety barrier in the event of a rupture or other failure of the sheet 34. At the same time, the open-mesh construction of the netting 38 permits essentially unrestricted jetting of fluid from the fluid jet arrangement 16 through the netting 38 and against the underside of the sheet 34.

Other than the portion of the interior chamber 25 occupied by the water stored in the basin 28 and the area occupied by the fluid jet arrangement 16 and the fluid supply arrangement 18, the interior chamber 25 of the housing 20 is substantially filled with air. In addition, a motor-operated fan 40 is mounted to the housing 20 outside the interior chamber 25 and communicates with the interior of the chamber 25 through a tubular conduit 42 to slightly pressurize the air within the chamber 25 during use of the massage apparatus 10 to slightly inflate the sheet 34 to enhance the feeling of support to a user laying on the sheet 34 and at the same time to maximize conformity of the sheet 34 to the body of the user.

The fluid jet arrangement 16 includes an elongate massage head, generally indicated at 44, mounted at its opposite ends on a pair of carriage members 46, each having wheels 48 supported on a pair of tracks 50 which are affixed in parallel relation through substantially the full lengthwise extent of the chamber 25 on the respective longitudinally-extending, upwardly-facing surfaces of the shelf 26 to dispose the massage head 44 for traversing travel back-and-forth through substantially the full lengthwise extent of the chamber 25 with the elongate extent of the head 44 oriented transversely across substantially the full widthwise extent of the chamber 25. In its preferred form, the massage head 44 includes a substantially hollow, cylindrical outer body 52 closed at its opposite ends, with a plurality of emission openings 54 formed through the outer body 52 in staggered relation to one another over substantially the full extent of the upward surface of the body 52 which faces the sheet 34. Each emission opening 54 is preferably fitted with a venturi-type tubular jet nozzle 56 adapted to channel fluid passing therethrough in a jet-like spray A pair of tubular fittings 62 extend through the outer body 52 adjacent opposite ends thereof for admitting pressurized fluid from the fluid supply arrangement 18 as described below. An impeller 58 having a plurality of radially-extending vanes 60 is rotatably disposed within the hollow interior of the outer body 52 to be rotationally driven by pressurized fluid admitted into the outer body 52 through the fittings 62 in order to deliver such pressurized fluid to the emission openings 54 in a pulsating fashion so that, in turn, the jet sprays formed by the nozzles 56 are emitted in corresponding, generally discrete fluid pulses.

In order to drive reciprocal traversing travel of the massage head 44 back-and-forth through the lengthwise extent of the massage chamber 25, a drive bearing 64 is affixed to the underside of the outer body 52 of the massage head 44 and is threadedly mounted on an elongate threaded drive screw 66 extending longitudinally through the full length of the massage chamber 25 with its opposite ends rotatably supported by bearings 65 mounted to the housing 20. One end of the drive screw 66 projects outwardly through the housing 20 and carries a drive sprocket 68 driven by a timing belt 70 from the drive shaft 73 of a variable-speed, reversible DC electric drive motor 72, also affixed to the housing 20. In this manner, driven rotation of the screw 66 in opposite rotational directions effects traveling movement of the massage head 44 lengthwise through the chamber 25 in respectively opposite directions. The housing 20 is provided with a pair of windows 76 fitted sealably in the opposite ends of the housing 20 in the plane of reciprocal movement of the massage head 44 and a pair of electric eyes 74 are mounted to the housing 20 exteriorly of the windows 76 for sensing the presence of the massage head 44. Specifically, the electric eyes 74 are selected and arranged in association with the electric motor 72, as more fully explained below, to respectively recognize the presence of the massage head 44 at a desired point along its reciprocal path of travel at which reversal of its reciprocal movement is to be accomplished and, in turn, to actuate reversal of the electric motor 72 to initiate driving of the massage head 44 in the opposite direction at such point. A pair of spring-loaded shock absorbers 78 are mounted centrally at laterally opposite sides of the outer body 52 of the massage head 44 for the two-fold purpose of providing flat surfaces for reliable recognition by the electric eyes 74 and to cushion any unintended contact of the massage head 44 with the opposite ends of the housing 20 in the event of a malfunction of the motor reversing arrangement.

The pressurized fluid supply arrangement 18 includes a tubular fitting 80 mounted in a vertical side wall of the liquid reservoir basin 28 of the housing 20 to open into the basin at a submerged location below the normal liquid level therein during ordinary operation of the body massage apparatus 10. A tubular conduit 82 is connected to the fitting 80 and to the inlet side of a cooling radiator 84, the outlet side of which communicates through another tubular conduit 86 with the inlet side of a liquid pump 88 driven by an electric drive motor 90. The outlet side of the pump 88 communicates through another conduit 92 with an electrically-operated flow control valve 94 which, in turn, is connected to a conduit 96 extending sealably through the bottom wall of the housing 20 into the interior massage chamber 25. A U-shaped tubular fitting 98 is affixed to the distal end of the conduit 96 to form a pair of branch conduits 100, each of which is connected to a length of flexible tubing 102 connected at its opposite end to a respective one of the fittings 62 on the outer body 52 of the massage head 44. In this manner, operation of the pump 88 is effective to progressively withdraw the stored massage fluid from the liquid reservoir basin 28 and deliver the fluid under pressure into the interior of the massage head 44 to rotatably operate the impeller 58 which, in turn, forces the pressurized liquid outwardly in jetted pulses through the plural nozzles 56. Adjustment of the valve 94 permits control of the pressure of the liquid delivered to the massage head 44. The radiator 84 includes a generally sinuous interior conduit for flow therethrough of the liquid withdrawn from the basin 28 and an electrically-driven fan 104 is associated with the radiator 84 for selective operation as necessary or desirable to force ambient air over the sinuous conduit of the radiator 84 to cool the massage liquid to a desired temperature, the radiator 84 and fan 104 thereby operating in conjunction with the heater 75 to regulate the temperature of the massage liquid.

The electrical circuitry by which the various operating components of the body massage apparatus 10 are operated and controlled is schematically illustrated in FIG. 5. Operating electrical power for the body massage apparatus is supplied from an ordinary source of household 110 volt alternating electrical current, indicated at 106, across which are connected several operating circuits In a first actuating circuit 108, a normally-open manually-actuable power-on/off switch 110 is connected in series with a power supply contactor 114 through a manually-operable timing device 116. A set of normally-open contacts 122 of the supply contactor 114 are connected in parallel across the power-on/off switch 110 and two other sets of normally-open contacts 124,126 of the supply contactor 114 are respectively connected in the supply legs of the AC power supply 106 in advance of all other circuits. A microprocessor, preferably a programmable logic controller, indicated at 128, is connected in a branch circuit 130, with a number of control switches and components connected as inputs to the microprocessor as more fully explained hereinafter. An inverter 132 is connected in another circuit 134 for converting the alternating current power supply to direct current for supply to the DC motor 72 to the drive screw 66 and to respective liquid crystal displays (LCDs) 134,136,138. The LCD 134 is also connected to a pressure sensor 135 disposed in the conduit 92 intermediate the pump 88 and the valve 94 for displaying the prevailing liquid pressure in the fluid supply arrangement 18. Likewise, the LCD 138 is connected to a temperature sensor 140 submerged in the liquid reservoir basin 28 for displaying the prevailing temperature of the liquid therein. The LCD 136 is connected to the microprocessor 128, which has an internal clock or timing device, for displaying the elapsed operating time of each actuation of the massage apparatus 10. The operating motor 90 to the pump 88 is connected in another circuit across the power supply 106 and separate output terminals of the microprocessor 128 are connected respectively to the motors 72,90 for independent control of the actuation and deactuation of each thereof. A transformer 145 is connected in another circuit across the AC power supply 106 and is connected to the flow control valve 94 for supply operating direct current thereto. The resistance heating element 75 is connected in another operating circuit in series with a normally-closed thermostatic control switch 142, and the electric fan 104 associated with the radiator 84 is connected in a parallel circuit in series with a normally-open thermostatic control switch 144. The fan 40 for pressurizing the interior chamber of the apparatus is also connected across the power supply 106.

The microprocessor 128 is programmed to initiate and carry out operating cycles of the body massage apparatus 10 in response to the aforementioned control components which are connected in parallel to respective input terminals of the microprocessor. A normally-open manually-actuable switch 146 is connected to one microprocessor input terminal in response to the closing of which the microprocessor is programmed to initiate an operating cycle of the body massage apparatus 10. Similarly, a switch 145 is connected to another input terminal of the microprocessor 128 for selectively interrupting an operating cycle of the apparatus 10. Another normally-open manually-operable switch 150 is connected to another input terminal of the microprocessor 128 and the microprocessor 128 is programmed to reverse operation of the motor 72 to the drive screw 66 upon each closing of the switch 150 and to store in memory the location of reversal, another switch 152 being provided for clearing the stored value or values from the microprocessor memory. A switch 156 is alternately connectable to a pair of input terminals of the microprocessor 128 for enabling this "automatic" operation of the memory function of the microprocessor 128 when the switch 156 is connected to one terminal and for disabling or bypassing memory storage of settings of the switch 150 when the switch 156 is connected to the other terminal, as more fully explained hereinafter. A variably-settable switch 154 is connected to another input terminal of the microprocessor 128 in response to which the microprocessor 128 is programmed to increase and decrease the driving speed of the motor 72. The electric eyes 74 are respectively connected to other input terminals of the microprocessor 128 which is programmed to actuate reversals of the electric motor 72 in response to the electric eyes 74. A switch 148 is also connected to the flow control valve 94 to actuate valve opening and closing movements thereof.

Figure 4:
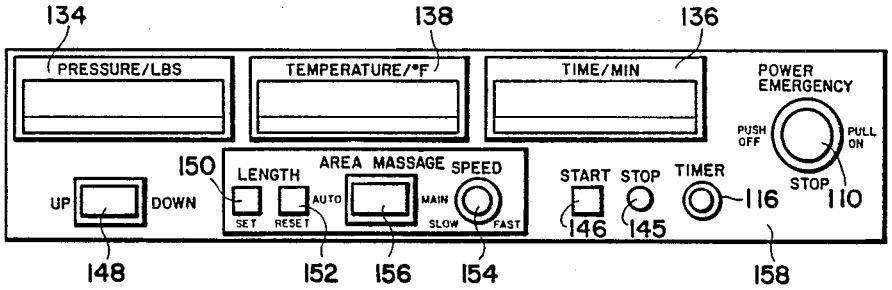
FIG. 4 is a front elevational view of the control panel for the body massage apparatus of FIG. 1.

For convenience of operation and control of the apparatus 10, the power-on/off switch 110, the timer 116, the LCDs 134,136,138, the start switch 146, the stop switch 145, the pressure control switch 148, the localized massage set, reset and automatic-manual switches 150,152,156, and the speed control switch 154 are mounted on a control panel 158 shown only in FIG. 4, which is preferable mounted at or adjacent one end of the bed structure 12 for convenient access and operation by a user while laying on the sheet 34. Normally, for safety reasons, the thermostatic control switches 142,144 are not accessible or controllable by the user from the control panel 158 in embodiments of the body massage apparatus 10 intended for use by unattended users. On the other hand, it is contemplated that a switch or switches may be provided at the control panel 148 for selective adjustment of the thermosatic control switches 142,144 for selective increase or decrease of the liquid temperature to suit the needs or desires of a particular user in embodiments of the body massage apparatus 10 which will normally be attended by an independent operator having the responsibility for monitoring the apparatus 10 and the user.

The operation of the body massage apparatus of the present invention may thus be understood. Initially, the power-on/off switch 110 and the timer switch 116 are manually closed to enable the apparatus 10, the power supply contactor 114 thereby being energized to close its respective contacts 122,124,126. In turn, the heating element 75 is energized to initiate heating of the liquid supply in the reservoir basin 28 and the fan 40 is actuated to slightly pressurize the interior chamber 25. The temperature sensor 140 monitors the rising temperature of the liquid in the basin 28 and displays the temperature on the LCD 138. Normally, use of the apparatus will not be initiated until the liquid temperature reaches a desirable level. At that time, a user mounts the bed structure 12 and lays on the sheet 34 in either a supine or prone position. Thereupon, the switch 146 is manually closed, either by the user or an operator of the apparatus 10, and the microprocessor 128 immediately energizes the motor 90 to initiate pressurized fluid flow through the pump 88 and simultaneously energizes the electric motor 72 to initiate traveling movement of the massage head 44.

As the massage head 44 travels back-and-forth lengthwise within the chamber 25, the pressurized liquid is delivered from the pump 88 through the intervening conduits into the interior of the outer body 52 of the massage head 44 and in jet-like pulses therefrom through the emission nozzles 56 by the rotary action of the impeller 58 under the pressurized force of the moving liquid. The relative thinness of the sheet 34 together with its resilient flexibility causes the sheet 34 to conform relatively closely to the shape and contours of the user's body and, in turn, the impact of the jetted pulses of liquid against the underside of the sheet 34 is readily transmitted therethrough to the body of the user to produce a massaging effect on the user's body. As the massage head 44 reaches each opposite end of the interior chamber 25 in its traveling movement, the electric eyes 74 recognize the presence of the massage head 44 and, in turn, the microprocessor 128 immediately actuates reversal of the electric motor 72 to initiate driving of the massage head 44 in the opposite direction. In this manner, the massage head 44 travels back-and-forth the full length of the interior chamber 25 to apply a massaging effect over the user's entire body.

In case the user desires the massaging effect to be concentrated along a lesser extent of the body, the switch 150 may be actuated at the points between which the user desires to restrict the travel of the massage head 44. In the "automatic" setting of the switch 156, the microprocessor 128 stores the settings represented by the closings of the switch 150 and thereafter actuates reversals of the electric motor 72 when the massage head 44 reaches each reversal location to maintain reciprocal travel of the massage head 44 within the desired area. Actuation of the switch 152 clears the stored settings to return the massage head 44 to full-length travel within the massage chamber 25. In the "manual" setting of the switch 156, the microprocessor 128 does not store any settings represented by closings of the switch 150 so that manual closing of the switch 150 is necessary for each desired reversal of the massage head 44.

Throughout operation of the body massage apparatus 10, the microprocessor 128 monitors the elapsed real time since initial closing of the switch 146 and displays the elapsed time on the LCD 136. Similarly, the pressure sensor 135 continuously monitors the prevailing pressure in the conduit 92 and displays the pressure value on the LCD 134. Likewise, the temperature sensor 140 continuously monitors the prevailing temperature of the liquid in the reservoir basin 28 and displays the temperature value on the LCD 138.

The thermostatic control switch 142 is operative to open when the temperature of the liquid reaches a value corresponding to the setting of the switch 142 and to thereafter repetitively close and open to maintain the temperature of the liquid at such setting. However, it has been found that the repetitive impact of the liquid against the sheet 34 over an extended period of operation of the apparatus 10 tends to increase the overall temperature of the liquid in the apparatus despite the opening of the control switch 142 and resultant deenergization of the heating element 75 so that the switch 142 may be insufficient under such circumstances to maintain a constant liquid temperature. Accordingly, the control switch 144 is operative to close at a predetermined maximum desired liquid temperature to energize the radiator fan 104 for cooling the liquid to maintain its temperature within a desired range.

Once the time period set by the timer switch 116 has elapsed, the timer switch 116 immediately opens, thereby deenergizing the supply contactor 114 and, in turn, opening its contacts 122,124,126 to deactuate the entire apparatus.

The present body massage apparatus 10 will thus be understood to provide a number of distinct advantages. First, the body massage apparatus 10 allows a user to obtain a vigorous massage of his or her entire body or any localized part thereof and to selectively adjust the vigorousness of the massage by operation of the pressure control switch 148 to the flow control valve 94, the speed of travel of the massage head 44 by operation of the switch 154 and the time period of the massage by selective setting of the timer 116. The apparatus 10 is completely liquid tight so that the user does not become wet during the massaging operation and is not required to disrobe, thereby providing optimal convenience for the user. Further, all of the operating components, particularly the plumbing of the fluid jet and pressurized fluid supply arrangements 16,18, are housed within the bed structure 12 to simplify its overall construction and minimize the plumbing requirements of the apparatus and any possibility of undesired leakage thereof. As such, the water massage apparatus 10 provides a highly effective means for users to obtain therapy for muscular strains and injuries as well as general overall body relaxation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for body massage comprising:

a bed structure having a housing defining an interior massage chamber and an upwardly-facing opening communicating with said massage chamber, and a resiliently flexible membrane affixed to said housing in substantially sealing relation generally horizontally across said opening, said membrane being in sufficiently tensioned condition for forming a primary weight-bearing body support surface on which a user may lay for massage treatment while retaining sufficient resiliency and flexibility in its tensioned condition to generally conform to a user's body, said chamber being substantially filled with air;

fluid jet means disposed within said chamber for directing a fluid jet emission at said membrane; and means for supplying a quantity of massage fluid under pressure to said fluid jet means for emission thereby with sufficient force to transmit a massaging effect through said membrane to the body of a user laying thereon.

2. Apparatus for body massage according to claim 1 and characterized further by a net affixed to said housing in tensioned condition generally horizontally across said opening beneath said membrane for auxiliary support of a user, said net being of an open mesh construction for generally unrestricted passage therethrough of said massage fluid.

3. Apparatus for body massage according to claim 1 and characterized further in that said fluid jet means includes means for emitting said massage fluid in rapidly succeeding pulses.

4. Apparatus for body massage according to claim 1 and characterized further by means for regulating the temperature of said massage fluid.

5. Apparatus for body massage according to claim 1 and characterized further in that said fluid jet means is movable for traversing travel substantially along said membrane.

6. Apparatus for body massage according to claim 5 and characterized further by track means for guiding traversing movement of said fluid jet means.

7. Apparatus for body massage according to claim 5 and characterized further by means for driving traversing movement of said fluid jet means, said driving means comprising a reversible motor and control means for reversing said motor.

8. Apparatus for body massage according to claim 7 and characterized further in that said control means includes sensing means defining opposite ends of the traversing travel of said fluid jet means.

9. Apparatus for body massage according to claim 8 and characterized further in that said control means includes a means for selectively determining a lesser extent of traversing travel of said fluid jet means intermediate said sensing means.

10. Apparatus for body massage according to claim 7 and characterized further in that said driving means comprises a drive screw extending longitudinally through said massage chamber, said drive screw being operatively connected with said reversible motor for driven rotation of said drive screw in opposite directions and said fluid jet means being threaded mounted on said drive screw for driven movement therealong upon rotation thereof.

11. Apparatus for body massage comprising:

a bed structure having a housing defining an interior massage chamber, a liquid reservoir basin beneath said massage chamber, and an upwardly-facing opening communicating with said massage chamber, and a resiliently flexible membrane affixed to said housing in substantially sealing relation generally horizontally across aid opening, said membrane being in sufficiently tension condition for forming a primary weight-bearing body support surface on which a user may lay for massage treatment while retaining sufficient resiliency and flexibility in its tensioned condition to generally conform to a user's body, said reservoir basin containing a quantity of a massage liquid and said massage chamber being substantially filled with air whereby said massage liquid provides essentially no weight bearing support of the user;

a massage head movably disposed within said massage chamber for traversing travel substantially along, and in facing relation to, said membrane, said massage head including a plurality of emission openings for directing fluid jet emissions at said membrane; and means for withdrawing said massage liquid from said reservoir basin and supplying said liquid under pressure to said massage head for emission through its said emission openings with sufficient force to transmit a massaging effect through said membrane to the body of a user laying thereon.

12. Apparatus for body massage according to claim 11 and characterized further by a net affixed to said housing in tensioned condition generally horizontally across said opening beneath said membrane for auxiliary support of a user, said net being of an open mesh construction for generally unrestricted passage therethrough of said massage liquid.

13. Apparatus for body massage according to claim 11 and characterized further in that said massage head includes means for emitting said massage liquid in rapidly succeeding pulses.

14. Apparatus for body massage according to claim 11 and characterized further by means for regulating the temperature of said massage liquid.

15. Apparatus for body massage according to claim 11 and characterized further by track means for guiding traversing movement of said massage head.

16. Apparatus for body massage according to claim 11 and characterized further by means for driving traversing movement of said massage head, said driving means comprising a reversible motor and control means for reversing said motor.

17. Apparatus for body massage according to claim 16 and characterized further in that said control means includes sensing means defining opposite ends of the traversing travel of said massage head.

18. Apparatus for body massage according to claim 17 and characterized further in that said control means includes a means for selectively determining a lesser extent of traversing travel of said massage head intermediate said sensing means.

19. Apparatus for body massage according to claim 16 and characterized further in that said driving means comprises a drive screw extending longitudinally through said massage chamber, said drive screw being operatively connected with said reversible motor for driven rotation of said drive screw in opposite directions and said massage head being threadedly mounted on said drive screw for driven movement therealong upon rotation thereof.

* * * * *

PRINTER'S TRIM LINE

UNITED STATES PATENT AND TRADEMARK OFFICE

CERTIFICATE OF CORRECTION

PATENT NO. : 4,976,256

DATED : December 11, 1990

INVENTOR(S) : Dave B. Marlin and Earl B. Marlin, Jr.

It is certified that error appears in the above-identified patent and that said Letters Patent is hereby corrected as shown below:

Column 1, Line 12, after "masseurs" add -- . --.

Column 2, Line 58, after "22" add -- . --.

Column 3, Line 13, reads "26," but should read -- 26' --.

Column 4, Line 56, after "spray" add -- . --.

Column 6, Line 17, after "circuits" add -- . --.

Column 7, Line 38, reads "preferable" but should read -- preferably --.

Column 10, Line 62, reads "aid" but should read -- said --.

Column 10, Line 63, reads "tension" but should read -- tensioned --.

Signed and Sealed this

Twenty-ninth Day of September, 1992

*Attest:*

DOUGLAS B. COMER

*Attesting Officer*

*Acting Commissioner of Patents and Trademarks*